US009150287B1

(12) United States Patent
Sagucio

(10) Patent No.: US 9,150,287 B1
(45) Date of Patent: Oct. 6, 2015

(54) WET RIDER WATERCYCLE

(71) Applicant: Esteban N. Sagucio, North Las Vegas, NV (US)

(72) Inventor: Esteban N. Sagucio, North Las Vegas, NV (US)

( * ) Notice: Subject to any disclaimer, the term of this patent is extended or adjusted under 35 U.S.C. 154(b) by 0 days.

(21) Appl. No.: 14/121,534

(22) Filed: Sep. 17, 2014

Related U.S. Application Data

(60) Provisional application No. 61/960,787, filed on Sep. 27, 2013.

(51) Int. Cl.

| | |
|---|---|
| ***B63H 16/20*** | (2006.01) |
| ***B63B 35/73*** | (2006.01) |
| ***B63H 1/14*** | (2006.01) |
| ***B63H 25/02*** | (2006.01) |
| ***B63H 25/06*** | (2006.01) |

(52) U.S. Cl.
CPC ..... *B63B 35/731* (2013.01); *B63H 1/14* (2013.01); *B63H 16/20* (2013.01); *B63H 25/02* (2013.01); *B63H 25/06* (2013.01); *B63H 2016/202* (2013.01); *B63H 2025/024* (2013.01)

(58) Field of Classification Search
CPC ..... B63H 16/20
USPC ..... 440/26, 29
See application file for complete search history.

(56) References Cited

U.S. PATENT DOCUMENTS 5,183,422 A * 2/1993 Guiboche ..... 440/26
5,921,824 A * 7/1999 Ilagan ..... 440/26

* cited by examiner

*Primary Examiner* — Lars A Olson

(57) ABSTRACT

An elongate and tubular body of a watercycle, featuring a fish, for recreation and for exercise in the water, includes two humps on its back serving as saddle for a rider. The seated rider gets wet up to about the waist. The watercycle and the rider are floated by a highly buoyant material located within the upper body of the watercycle. Forward movement is initiated by manipulating the pedals to get the propellers in the body turning.

4 Claims, 4 Drawing Sheets

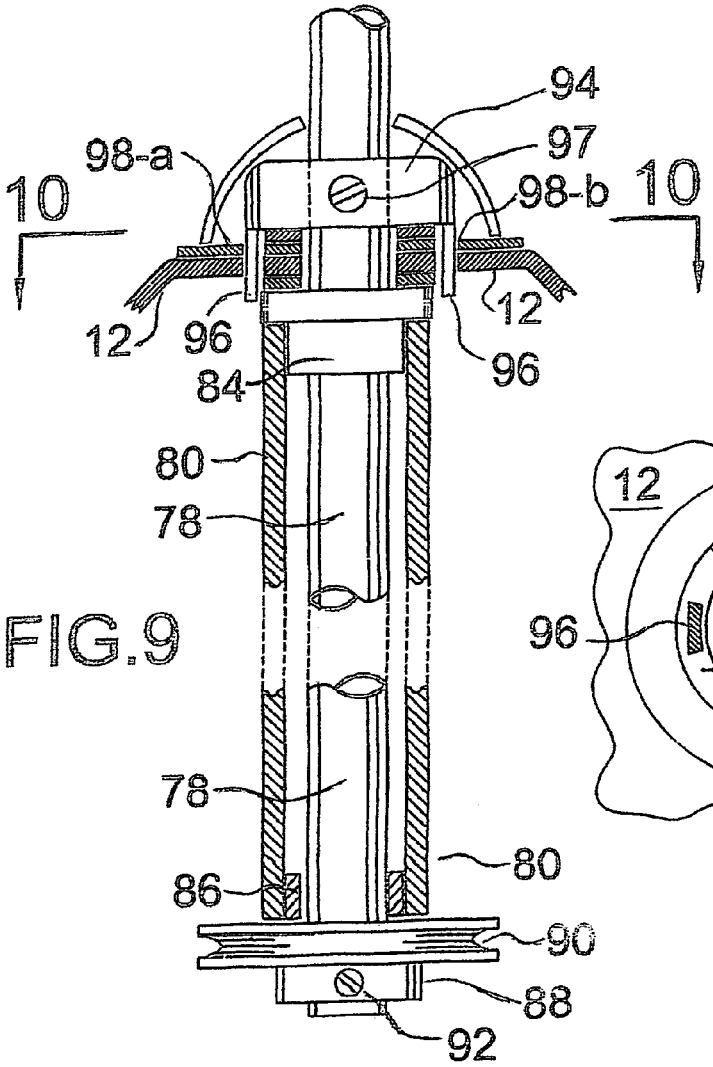
FIG.9
FIG.10
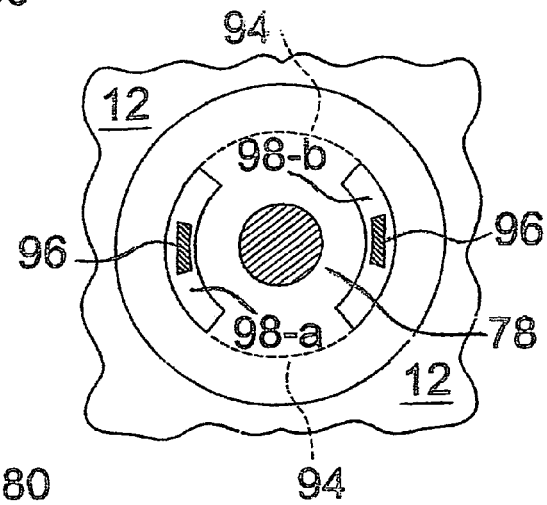

WET RIDER WATERCYCLE

This application claims the benefit of Provisional Patent Application Ser. No. 61/960,787 filed Sep. 27, 2013 by the present inventor.

BACKGROUND

This water ride includes a float and propellers disposed within an elongate, tubular body. It is slow-moving and is ideal for use in the backyard swimming pool and on the beach, or water park where there is a big crowd a times. A rider manipulates the pedals to get the watercycle to move forward.

Commonly used small water rides are assorted figures crafted from foam, and inflatable rubber or plastic material in many forms. These above mentioned water rides have no means of propulsion and it is necessary that younger kids be assisted by elders or parents. Many times kids would use their hands to paddle, or legs to propel themselves.

One advantage with this unique watercycle is that the propellers are well shielded within the body and this makes it very safe for swimmers in the vicinity.

Another advantage is that it is relatively slow-moving and this makes it safe even in a crowd of bathers.

Still another advantage is that the float portion of the watercycle is likewise within the body and this makes it more resistant to deterioration, which may be caused by weather and abrasion from rough handling.

SUMMARY

Several ways may be adapted to set the propellers within the body of the watercycle, like for example: (1) two propellers mounted side-by-side on one shaft, each propeller being accommodated within respective openings; (2) one propeller mounted on a shaft and accommodated within one opening; and (3) two propellers mounted in tandem on the same shaft and accommodated within one opening.

A preferred diversion wall, shown in FIG. 3, having multiple openings is disposed perpendicularly within the lower body with the two ends attached to either inboard side walls. When the propellers turn, water flow enters the front open end and is guided towards the suction side of the openings wherein corresponding propellers are disposed. The side of the diversion wall facing the in-coming water flow is the suction side, while the reverse side of said diversion wall is the discharge side.

THE DRAWINGS

Figure 2:
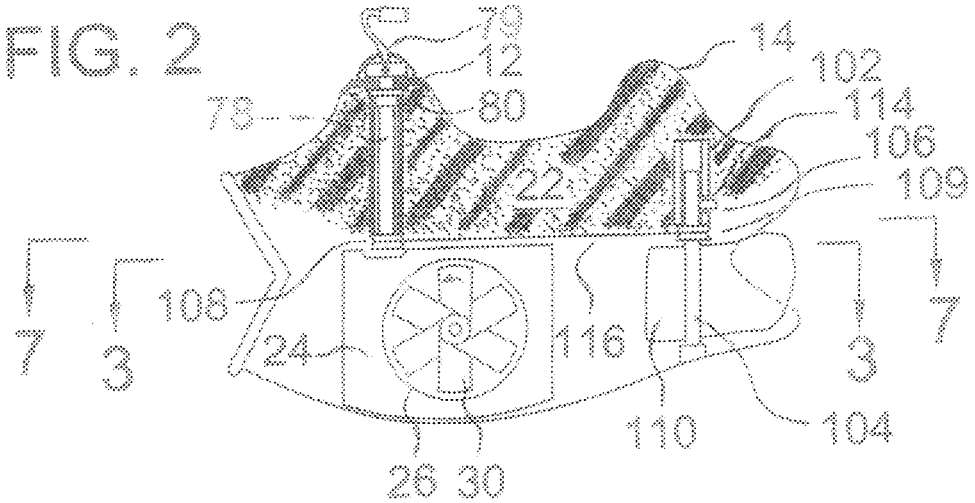
FIG. 2 is the watercycle shown in FIG. 1 with the left side removed. It shows the main parts located within the body of the watercycle.
Figure 3:
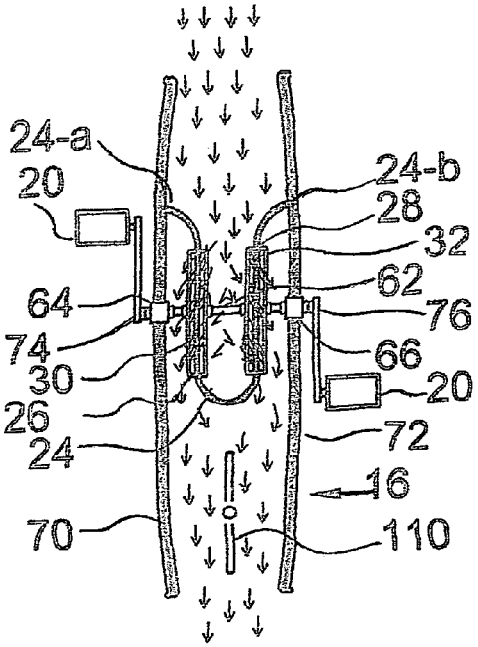

FIG. 3 is a top view taken along line 3-3 of FIG. 2. The diversion wall is "U"-shaped and its two ends are attached to either forward, inboard side walls of the body. Two propellers are mounted side-by-side on a shaft.

Figure 4:
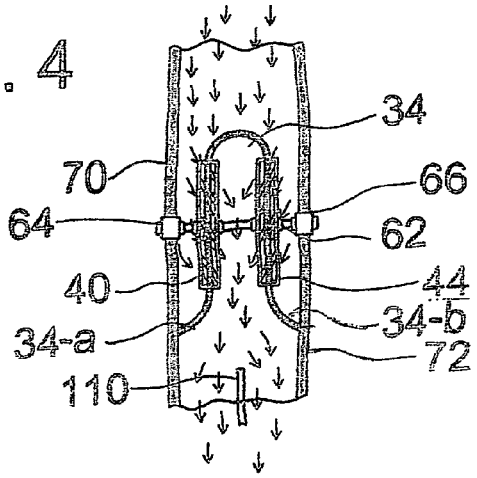

FIG. 4 is similar to FIG. 3, except that the diversion wall is reversed, and that the two ends are attached to the rearward portion of the body.

Figure 5:
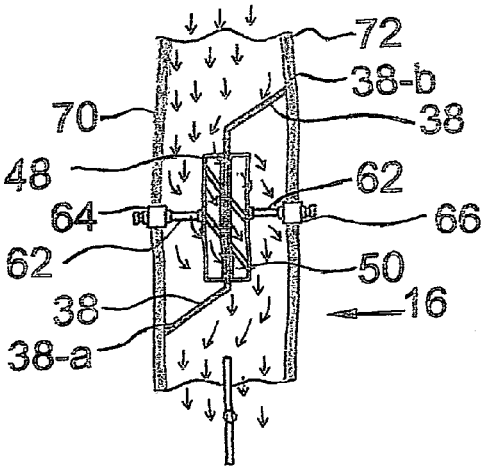

FIG. 5 shows a diversion wall disposed generally diagonal within the body. One end of said wall is attached to the inboard, forward portion of one side of the body while the other end is attached to the inboard, rearward of the opposite side.

Figure 6:
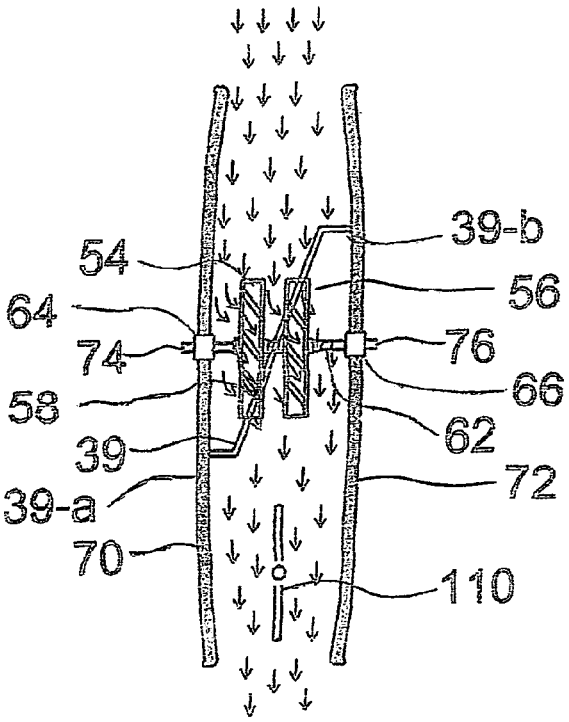

FIG. 6 shows a diversion wall disposed generally diagonal, and is attached to the body similar to that in FIG. 5. Two propellers in tandem are disposed.

Figure 7:
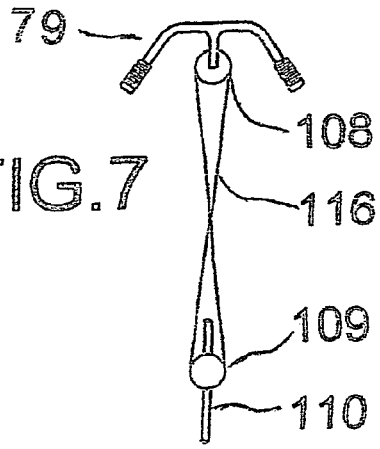

FIG. 7 is a schematic in the top view, taken along line 7-7 of FIG. 2 of the steering mechanism for translating rotation from handlebar to rudder unit A cord with figure-"8" arrangement is used.

Figure 8:
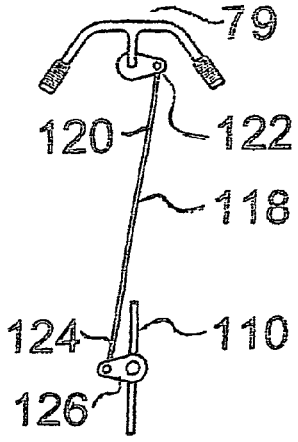

FIG. 8 is another form of mechanism for translating rotation from handlebar to rudder unit; a link rod is used.

FIG. 9 is an enlarged sectional view of the steering column of FIG. 2. It shows how the steering column is mounted atop the front hump of the watercycle.

FIG. 10 is a top view taken along line 10-10 of FIG. 9.

DESCRIPTION

Figure 1:
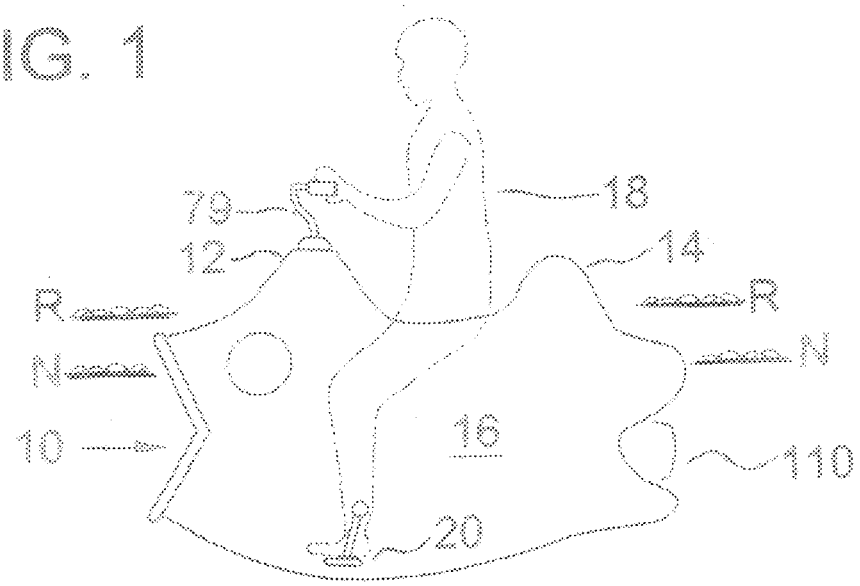
FIG. 1 is a left side view of the watercycle in the form of a fish with two humps on its back. A rider sits between the humps, which serves as a saddle.

Referring to the drawings in greater detail, FIG. 1 shows a watercycle 10 with body in the form of a fish having two humps 12 and 14 on its back. When no rider is onboard, the waterline is at N. However, when a rider is onboard, the waterline is at R. A rider sits between the humps, which serves as a saddle. The body 16 may be made of plastic or fiberglass. A rider 18 manipulates the pedals 20 to move the watercycle in the water.

In a preferred embodiment, shown in FIG. 2, the upper portion of the body is provided with highly buoyant float 22 like molded or pour-foam, or any other suitable material for floating the watercycle and its rider.

A perpendicular diversion wall 24 (see also FIG. 3), taken along line 3-3 of FIG. 2, with its two ends 24-*a* and 24-*b*, is attached opposingly to the forward portion, inboard sides of the body 16. Two openings 26 and 28 (see also FIG. 2) are provided on the diversion wall to accommodate the respective propellers 30 and 32 thereinto. The openings are sized to have larger diameter than the diameter of the propellers. The diversion wall is provided to guide water flow towards openings 26 and 28 (see also FIG. 2), when the propellers 30 and 32 are rotating. In FIG. 4 is an alternative set-up of the diversion wall, similar to that shown in FIG. 3. The diversion wall 34 is reversed so that the two ends 34-*a* and 34-*b* are attached oppositely towards the rear portion, inboard sides of the body.

Other arrangements of the diversion walls are shown in FIGS. 5 and 6. The walls 38 and 39 are oriented generally diagonal within the body. One end 38-*b* (FIG. 5) of the diversion wall is attached to the right inboard, forward portion of the body, and the other end 38-*a* is attached to the left inboard rearward portion. Diversion walls 38 (FIG. 5) and 39 (FIG. 6) are identical and therefore no further discussion is deemed necessary.

In FIGS. 3 and 4, the diversion walls 24 and 34 are each having two openings 26 and 28 (not shown), and 40 and 44 (both not shown). Each opening includes a propeller accommodated therein. In FIG. 5 is shown a single propeller 48 accommodated within a single opening 50. In FIG. 6, however, two propellers 54 and 56 are placed in tandem in one shaft 62 and accommodated in the proximity of a single opening 58.

A propeller shaft 62 is disposed horizontally athwartly across the body of the watercycle with bearings 64 and 66 on either sidewalls 70 and 72. This shaft set-up likewise applies to all arrangements shown in FIGS. 3 through 6. Pedals 20-*a* and 20-*b* are respectively attached to shaft ends 74 and 76.

When pedaling for forward movement, the shaft 62 and including the propeller rotate counter-clockwise (see FIG. 2)

when viewed from the left side. It will be noted that the propeller blades are set or angled such that the leading edges are facing the suction side, or towards the source of water flow, indicated by the small arrows. Thus, water passes through the openings when the pedals are manipulated, and thereby give the watercycle a push-forward reactive movement.

The handlebar column 78 (FIGS. 2 and 9) is pivotally mounted atop the front hump 12. A protective tube 80 is provided to ensure free rotation of the handlebar column. A flanged bushing 84 on the upper end of the tube and another bushing 86 on the bottom end are placed tight-fit against the inside wall of the tube 80. The inside diameter of bushing 84 and 86 are larger than the diameter of the column 78 to ensure free rotational movement of the latter.

A collar 88 integral with a pulley 90 and attached with setscrew 92 onto the bottom end of the column supports the tube 80 from sliding down. A larger collar 94 with stop prongs 96 projecting downwardly from its periphery is attached with setscrew 97 onto the handlebar column to keep the latter from sliding down. The stop prongs 96 penetrate through arcuate openings 98-*a* and 98-*b* which serve to limit rotational movement of the handlebar column when steering.

A protective tube 102 (FIG. 2) is provided for rudder shaft 104. A pin 106 is radially attached to limit angular rotation of the shaft 104. Also attached to the rudder shaft is a pulley 109 and a rudder 110. The protective tube 102 includes a transverse slot 114, of length, adopted to permit limited rotation of the rudder shaft 104 when steering.

The pulley 108 at the bottom end of the handlebar column and the pulley 109 intermediate the rudder shaft are interconnected by a cord 116 (see FIG. 7) in a figure-"8" pattern. With this operative hitch, when the handlebar is rotated in one direction, the rudder shaft rotates in the other direction.

An alternative steering arrangement is shown in FIG. 8. A link rod 118 is articulated with its first end 120 to a first ear 122 affixed to the handlebar shaft 78 and its second end 124 is articulated with the second ear 126 affixed to the rudder shaft 104. Thus, when the handlebar is rotated in one direction, the rudder shaft 104 with the rudder 110 rotates in the other direction, by actuation of the link rod 118.

Pour-foam or spray-on method of stuffing foam into the upper body, shown in FIG. 2, may be used to produce floatation means for the watercycle. Or, any other suitable material with excellent buoyancy can be used. If pour-foam or spray-on foam is used, the handlebar protection tube 80 and the rudder shaft protection tube 102 are embedded in the foam 22 and this make them structurally steady.

Various changes in shape and form may be apparent to those skilled in the art and such may be within the spirit and scope of the invention as defined by the claim herein appended.

What I claim:

1. A watercycle for exercise and for recreation in water comprising:

(a) an elongate, generally tubular body having open front and rear ends defining a passage of water flow entering said front open end and exiting said rear open end when a rider manipulates pedals for forward movement of the watercycle:

(b) a propeller shaft rotatably mounted horizontally, transversely through openings on opposing sidewalls of said tubular body at a location intermediate said front and rear open ends, said shaft being provided on each end with external pedal means thereof;

(c) float means disposed within an upper portion of said body is provided, said float means for buoying up of said rider and said watercycle;

(d) steering means including a first pulley attached onto a bottom end portion of a handlebar shaft, and a second pulley attached onto an intermediate location on a rudder shaft means, said first and second pulleys being interconnected by a cord in a figure-8 arrangement, whereby when said handlebar, and hence the first pulley, is rotated in one direction, the rudder shaft with rudder, will rotate in the opposite direction;

(e) diversion means for guiding water flow within said body, said diversion means includes a perpendicular wall disposed on a lower portion of said body, having opposed ends attached to respective inboard sides of said sidewalls.

2. The watercycle of claim 1 wherein said propeller shaft is disposed with two side-by-side propellers, each having respective set of blades angled oppositely of each other and arranged to individually simultaneously produce water flow toward said rear end of said body when the pedals are manipulated; said watercycle further includes a U-shaped diversion wall having two openings for accommodating said propellers.

3. The watercycle of claim 1 wherein said propeller shaft is disposed with a single, centrally set propeller having blades angled such that when the pedals are operated for forward movement of the watercycle, water flow is directed toward the rear end of said tubular body, said watercycle further includes a generally diagonal diversion wall having an opening for accommodating said propeller.

4. The watercycle of claim 1 wherein said shaft is disposed with two propellers mounted in tandem and having their respective blades angled towards a common direction, arranged to assist each other to produce water flow toward the rear open end of said tubular body, through an opening in said diversion wall when the propellers are manipulated for forward movement; said watercycle further includes a generally diagonal diversion wall, having said opening, for accommodating said propellers.

* * * * *